US005804755A

United States Patent [19]

Furukawa

[11] Patent Number: 5,804,755

[45] Date of Patent: Sep. 8, 1998

[54] ELECTRONIC MUSICAL INSTRUMENT HAVING CHANNEL CONTROLLER PREFERENTIALLY ASSIGNING SOUND GENERATING CHANNELS TO RESONANT SOUND SIGNALS WITH LARGE MAGNITUDE

[75] Inventor: Rei Furukawa, Shizuoka, Japan

[73] Assignee: Yamaha Corporation, Japan

[21] Appl. No.: 932,469

[22] Filed: Sep. 18, 1997

[30] Foreign Application Priority Data

Sep. 20, 1996 [JP] Japan ..... 8-250306

[51] Int. Cl.[6] ..... G10H 1/02; G10H 1/22

[52] U.S. Cl. ..... 84/656; 84/662; 84/DIG. 2

[58] Field of Search ..... 84/618, 626–633, 84/656, 662–665, 684, 701–711, DIG. 2

[56] References Cited

U.S. PATENT DOCUMENTS 5,159,144 10/1992 Fujisawa et al. ..... 84/656

5,270,478 12/1993 Tetsuji et al. ..... 84/656 X 5,315,059 5/1994 Saito ..... 84/656

5,455,380 10/1995 Matsuda et al. ..... 84/662

*Primary Examiner*—Stanley J. Witkowski

*Attorney, Agent, or Firm*—Graham & James LLP

[57] ABSTRACT

An electronic keyboard musical instrument includes a plurality of sound generating channels selectively assigned to pairs of fundamental sound signals and pairs of resonant sound signals, and a channel controller assigns the sound generating channels to a new pair of resonant sound signals after release of sound generating channels from the assignment to a pair of resonant sound signals for a stereophonic sound with the minimum loudness when the sound generating channels have already assigned to the predetermined pairs of resonant sound signals so as to concurrently produce a large number of stereophonic sounds.

7 Claims, 10 Drawing Sheets

| CHANNEL No. / MUSIC DATA | 1 | 2 | 3 | | | 63 | 64 |
|---|---|---|---|---|---|---|---|
| KEY STATUS | 1 | 1 | 1 | | | 1 | 0 |
| KEY CODE | * | * | * | | | * | ** |
| KEY TOUCH | | | | | | | |
| KIND OF SOUND SIGNAL | 1 | 0 | 0 | | | 1 | 1 |
| COUPLING STATUS | 1 | 1 | 1 | | | 1 | 12 |
| ENVELOP VALUE | | | | | | | |
| LEFT/RIGHT SPEAKER | L | R | L | | | R | R |

Fig. 4

ELECTRONIC MUSICAL INSTRUMENT HAVING CHANNEL CONTROLLER PREFERENTIALLY ASSIGNING SOUND GENERATING CHANNELS TO RESONANT SOUND SIGNALS WITH LARGE MAGNITUDE

FIELD OF THE INVENTION

This invention relates to an electronic musical instrument and, more particularly, to an electronic musical instrument for producing a sound containing a fundamental tone and overtones.

DESCRIPTION OF THE RELATED ART

A typical example of an electronic keyboard musical instrument is illustrated in FIG. 1 of the drawings. The prior art electronic keyboard musical instrument can generate a sound containing a standard sound component and resonant sound components. The standard sound component is corresponding to a tone produced by an acoustic piano without manipulation of pedals. The prior art electronic keyboard musical instrument comprises a keyboard 1 accompanied with key sensors 2, a pedal 3 accompanied with a pedal sensor 4 and a signal processing unit 5. The pedal 3 is corresponding to a damper pedal of an acoustic piano.

The keyboard 1 consists of black keys 1*a* and white keys 1*b*, and the notes of a scale are respectively assigned to the black and white keys 1*a*/1*b*, respectively. A player selectively depresses the black and white keys 1*a*/1*b* so as to specifies the notes of sounds to be produced. The key sensors 2 monitor the keyboard 1 to see what key 1*a*/1*b* is depressed or released, and produces a key-on signal and a key-off signal for the depressed key and the released key. The key-on signal and the key-off signal are labeled with "KP1" in FIG. 1. When the player wants to impart an effect similar to that of the damper pedal to the sound, the player steps on the pedal 3, and the pedal sensor 4 produces a pedal signal PS1 representative of the stroke of the pedal 3. The key-on/key-off signal KP1 and the pedal signal PS1 are supplied to the signal processing unit 5, and the signal processing unit 5 produces an electronic sound signal SD1 on the basis of the key-on/key-off signals KP1 and the pedal signal PS1.

The signal processing unit 5 includes a tone generator 5*a* for producing a fundamental sound signal FS1 and a resonant sound signal RS1 for a depressed key 1*a*/1*b*, a multiplier 5*b* and an adder 5*c*. The fundamental sound signal FS1 is representative of the standard sound component for a depressed key 1*a*/1*b*, and the resonant sound signal RS1 represents the resonant sound components for the depressed key 1*a*/1*b*. The resonant sound components are determined as follows.

A player depresses a black/white key of an acoustic piano without manipulation of the damper pedal, and the acoustic sound is sampled with time. The acoustic sound is represented by pieces of standard sound data, and the pieces of standard sound data form a signal waveform WF1. The pieces of standard sound data contain standard sound information for the standard sound component only. Subsequently, the player depresses the black/white key under the manipulation of the damper pedal, and the acoustic sound is also sampled with time. The acoustic sound is also represented by pieces of modified sound data, and the pieces of modified sound data contain not only the standard sound information for the standard sound component but also resonant sound information for the resonant sound components. When the pieces of standard sound data are subtracted from the pieces of modified sound data, pieces of resonant data are obtained for the resonant sound magnitude components, and the pieces of resonant data are represented by a signal waveform WF2. The fundamental sound signal FS1 has the signal waveform WF1, and the resonant sound signal RS1 has the signal waveform WF2.

A set of pieces of standard sound data and a set of pieces of resonant sound data are stored in the tone generator 5*a* for the black/white keys 1*a*/1*b*. When one of the black/white keys 1*a*/1*b* is depressed and, thereafter, released, the key-on/key-off signals KP1 are supplied to the signal processing unit 5, and the pieces of standard sound data and the pieces of resonant sound data are read out from the tone generator 5*a* as the fundamental sound signal FS1 and the resonant sound signal RS1, respectively.

Assuming now that the player steps on the pedal 3 after the depressing of the black/white key 1*a*/1*b*, the stroke of the pedal 3 is varied as represented by plots STK1, and the pedal signal PS1 is supplied to the multiplier 5*b*. The multiplier 5*b* multiples the pieces of resonant sound data by the stroke, and produces an actual resonant sound signal RS2 representative of the pieces of resonant sound data. The actual resonant sound signal RS2 is supplied to the adder 5*c*, and the pieces of actual resonant sound data are added to the pieces of standard sound data. The sum represents the electronic sound containing the standard sound component and the resonant sound components, and the adder 5*c* produces the electronic sound data signal SD1 representative of the sum. When a suitable sound system (not shown) produces an electronic sound from the electronic sound signal SD1, the electronic sound contains the standard sound component and the resonant sound components, and imparts deep impression to listeners.

The prior art keyboard musical instrument has a plurality of sound generating channels less than the total number of black/white keys 1*a*/1*b*. The sound generating channels provide signal paths from the tone generator 5*a* for the fundamental sound signal FS1 and the resonant sound signal RS1. If the prior art electronic keyboard musical instrument is designed to produce a stereophonic sound, two standard sound components and two resonant sound components are supplied through four sound generating channels to the stereophonic speaker system for each electronic sound. When a plurality of electronic sounds are concurrently produced from the stereophonic speaker system, the fundamental sound signals and the resonant sound signals occupy the sound generating channels as many as the product of the number of electronic sounds multiplied by four. For example, the prior art keyboard musical instrument is assumed to have sixty-four sound generating channels. The signal processing unit 5 can concurrently produces only sixteen electronic sounds. In this situation, if a player quickly fingers on the keyboard 1, there is a possibility that fundamental sound signals and resonant sound signals for some electronic sounds are not assigned to the sound generating channels due to the shortage of the sound generating channels, and these electronic sounds are omitted from the performance.

If the sound generating channels are simply increased, the problem is solved. However, a large number of sounds generating channels increase the production cost of the prior art electronic keyboard musical instrument. Thus, there is a trade-off between the number of electronic sounds to be concurrently produced and the production cost of the electronic keyboard musical instrument.

SUMMARY OF THE INVENTION

It is therefore an important object of the present invention to provide an electronic musical instrument which can concurrently produces a large number of electronic sounds wit lout increase of sound generating channels.

To accomplish the object the present invention proposes to preferentially assign sound generating channels to resonant sound signals with large magnitude.

In accordance with one aspect of the present invention, there is provided an electronic musical instrument capable of concurrently producing more than one electronic sound, comprising a plurality of tone specifying means manipulated by a player for specifying a note of a fundamental sound to be produced, the player being able to manipulate more than one tone specifying means so as to specify more than one fundamental sound to be concurrently produced, at least one musical effect applying means manipulated by the player for imparting a music effect to the fundamental sound or the more than one fundamental sound, a tone generating means for producing the fundamental sound or the more than one fundamental sound without a manipulation of the at least one musical effect applying means, and imparting the at least one music effect to the fundamental sound or the more than one fundamental sound under the manipulation of the at least one music effect modifying means, and the tone generating means includes a plurality of sound generating channels selectively assigned to a fundamental sound signal representative of the fundamental sound or fundamental sound signals representative of the more than one fundamental sound, the plurality of sound generating channels being further assigned to a sound modifying signal associated with the fundamental sound signal for imparting the musical effect to the fundamental sound or sound modifying signals respectively associated with the fundamental sound signals for imparting the music effect to the more than one fundamental sound, a signal generating means responsive to the plurality of tone specifying means and the musical effect applying means for producing the fundamental sound signal, the fundamental sound signals, the combination of the fundamental sound signal and the sound modifying signal or the combination of the fundamental sound signals and the sound modifying signals, and a channel controlling means checking the sound generating channels to see whether or not the sound generating channels assigned to the sound modifying signals exceed a predetermined number equal to or less than the maximum number of sound generating channels assignable to the fundamental sound signals, the channel controlling means restricting the total number of sound generating channels assigned to the sound modifying signals equal to or less than the predetermined number.

BRIEF DESCRIPTION OF THE DRAWINGS

The features and advantages of the electronic musical instrument will be more clearly understood from the following description taken in conjunction with the accompanying drawings in which:

FIG. 4 is a view showing a list of key assignment stored in a random access memory of the electronic keyboard musical instrument;

DESCRIPTION OF THE PREFERRED EMBODIMENTS

First Embodiment

Figure 1:
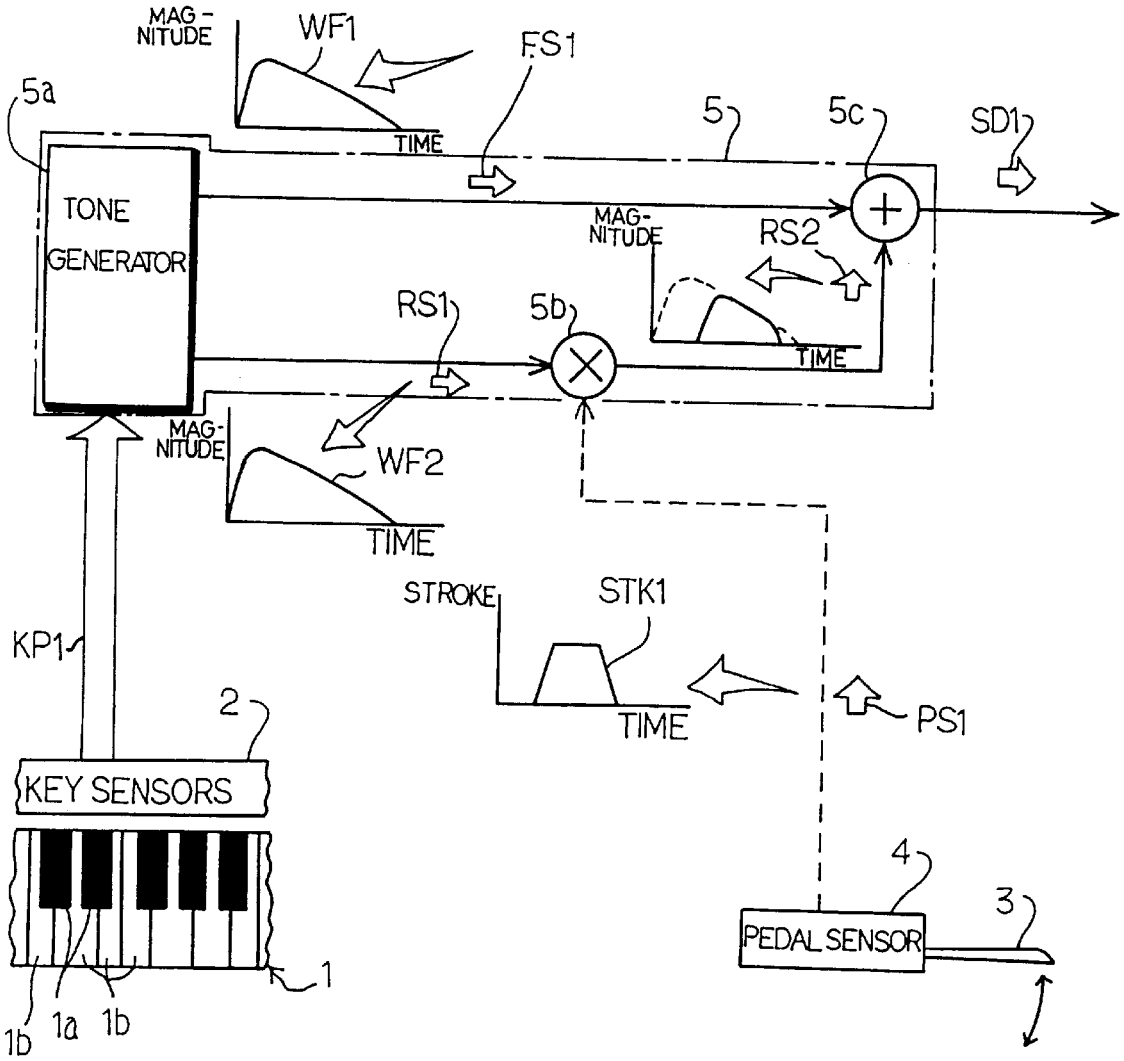
Fig. 1 PRIOR ART
FIG. 1 is a schematic view showing the prior art electronic keyboard musical instrument.
Figure 2:
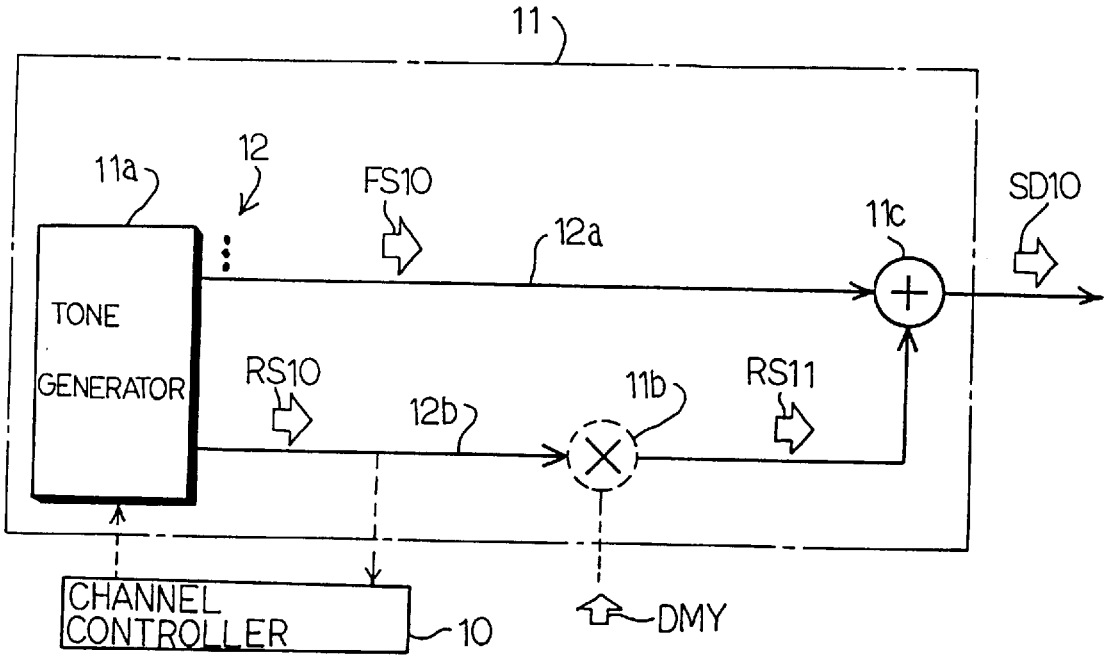
FIG. 2 is a schematic view showing sound generating channel assigned to a fundamental sound signal and a resonant sound signal for an electronic sound.

First, description is made on the function of a channel controller 10 for a tone generating unit 11. Referring first to FIG. 2 of the drawings, the channel controller 10 is associated with a tone generator 11*a* and a plurality of sound generating channels 2 connected to the tone generator 11*a*. Although only two sound generating channels 12*a* and 12*b* are shown in FIG. 2, more than two sound generating channels are connected to the tone generator 11*a*, and each sound generating channel is assignable to a fundamental sound signal FS10 or a resonant sound signal RS10. The fundamental sound signal FS10 is representative of a standard sound component of an electronic sound, and the resonant sound signal PS10 is representative of resonant sound components of the electronic sound. In the following description, when one of the sound generating channels is assigned to the fundamental sound signal FS10, the sound generating channel is called as "standard sound channel". If the sound generating channel is assigned to the resonant sound signal RS10, the sound generating channel is referred to as "resonant sound channel".

The sound generating channels 12*a* and 12*b* are assumed to have been assigned to the fundamental sound signal FS10 and the resonant sound signal RS10, respectively, and serve as the standard sound channel and the resonant sound channel, respectively. The multiplier 11*b* is connected to the resonant sound channel 12*b*, and pieces of resonant sound data are multiplied by a piece of dummy stroke data DMY. The piece of dummy stroke data DMY is constant regardless of an actual stroke of the pedal. When the pedal is changed from pedal-off status to pedal-on status, the piece of dummy stroke data is changed from "0" to "1". However, the pieces of actual stroke data may be supplied to the multiplier 11*b*. The pieces of actual stroke data are variable depending upon the stroke of the pedal.

An actual resonant sound signal RS11 is supplied from the multiplier 11*b* to the adder 1*c*, and the pieces of actual resonant sound data are added to the pieces of standard sound data. The sum represents an electronic sound containing the standard sound component and the resonant sound components, and an electronic sound signal SD10 is supplied from the adder 11*c* to a sound system (see FIG. 3). Thus, the electronic sound signal SD10 is produced in a similar manner to the electronic sound signal SD1.

The channel controller 10 monitors the sound generating channels 12 to see whether or not the resonant sound channels exceeds a predetermined number. If the resonant sound channels are less than the predetermined number, the channel controller 10 allows the tone generator 11*a* to assign a pair of sound generating channels, i.e., a resonant sound channel for a left speaker and a resonant sound channel for a right speaker to every stereophonic sound. However, if the resonant sound channels are equal to or greater than the predetermined number, the channel controller 10 instructs the tone generator 11*a* to release the sound generating channels already assigned from another key. The tone generator checks the resonant sound channels to see what resonant sound channels have been assigned to a pair of resonant sound signals lowest in sound level. When the tone generator 11*a* determines the pair of resonant sound channels already assigned to the resonant sound signals with the lowest sound level, the tone generator 11*a* releases the pair of resonant sound channels from the assignment. In this way, the electronic keyboard musical instrument can concurrently produce stereophonic sounds more than a quarter of the sound generating channels.

The predetermined number may be variable depending upon the number of the standard sound channels. If a player concurrently depresses a relatively small number of black/white keys, the predetermined number is a half of the total number of sound generating channels, and the tone generator 11*a* can impart the resonant sound components to every standard sound component. If the number of black/white keys concurrently depressed is increased, the predetermined number is decreased, and the tone generator 11*a* increases the stereophonic sounds concurrently produced. If the tone generator 11*a* restricts the resonant sound channels to be a half of the standard sound channels, the stereophonic sounds concurrently produced vary from a half of the total number of the sound generating channels to a quarter of the total number of the sound generating channels.

Figure 3:
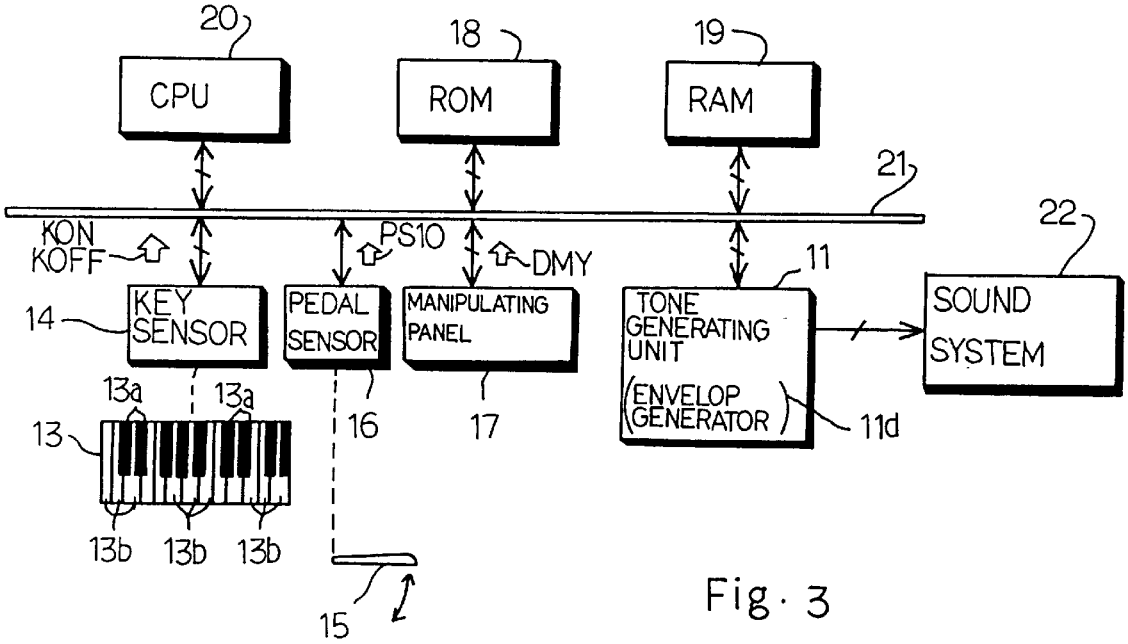
FIG. 3 is a block diagram showing the arrangement of an electronic keyboard musical instrument according to the present invention.

FIG. 3 illustrates the circuit arrangement of an electronic keyboard musical instrument embodying the present invention. The electronic keyboard musical instrument produces stereophonic sounds, and the tone generating unit 11 and sixty-four sound generating channels 12 are incorporated in the electronic keyboard musical instrument. The tone generating unit 11 may be of the type previously carrying out an assignment of the sound generating channels 12 to the standard sound signal or the resonant sound signal. A multi-timber type tone generating unit may be used in the electronic keyboard musical instrument. If the multi-timber type tone generating unit is used, the sound generating channels assignable to the resonant sound signals may be variable.

An envelope generator 11*d* is incorporated in the tone generating unit 11. The envelop generator 11*d* respectively produces a fundamental sound signal and a resonant sound signal from pieces of music data representing the pitch of a standard sound component, an envelop value and a timbre and pieces of music data representative of the pitches of resonant sound components, an envelop value and a timbre, and supplies the fundamental sound signal and the resonant sound signal to the sound generating channel assigned thereto.

The sixty-four sound generating channels are numbered from "1" to "64". Four sound generating channels are assigned to every stereophonic sound, and propagate the fundamental sound signal for a left speaker/the fundamental sound signal for a right speaker to the adder 11*c* and the resonant sound signal for the left speaker/the resonant sound signal for the right speaker through the multiplier 11*b* to the adder 11*c*. The adder 11*c* produces a sound data signal for the left speaker from the fundamental sound signal and the associated resonant sound signal and another sound data signal for the right speaker from the fundamental sound signal and the associated resonant sound signal. The sound data signals are supplied in parallel to the left speaker and the right speaker.

The electronic keyboard musical instrument further comprises a keyboard 13, a key sensor 14 provided for the keyboard 13, a damper pedal 15 and a pedal sensor 16 provided for the damper pedal 15. Although other pedals are further provided in the electronic keyboard musical instrument, they are deleted from FIG. 3 for the sake of simplicity. The keyboard 13 contains black keys 13*a* and white keys 13*b* and a player selectively depresses the black/white keys 13*a*/13*b* for playing a tune. The keyboard 13 is associated with the key sensor 14, and the key sensor 14 monitors the black/white keys 13*a*/13*b* to see what key is depressed and released. When a player depresses a black/white key 13*a*/13*b*, the key sensor 14 produces a key-on signal KON for the depressed key. On the other hand, when the player releases the depressed key, the key sensor 14 produces a key-off signal KOFF for the released key. Similarly, the pedal sensor 16 monitors the damper pedal 15 to see whether or not the player steps on the damper pedal 15. When the player steps on the damper pedal 15, the pedal sensor 16 produces a pedal position signal PS10 representative of the pedal status, i.e., pedal-on status or pedal-off status.

The electronic keyboard musical instrument further comprises a manipulating panel 17. The manipulating panel 17 includes a plurality of switches and a display window. A player instructs the electronic keyboard musical instrument to impart a timbre and effects to the stereophonic sounds through the switches, by way of example, and the selected timbre and effects are shown on the display window. The piece of dummy stroke data DMY is stored in a suitable memory of the manipulating panel 17.

The electronic keyboard musical instrument further comprises a read only memory 18 for storing programmed instruction codes and data tables, a random access memory 19 for temperability storing music data codes and pieces of control data, a central processing unit 20 for executing a program sequence described hereinlater and a bus system 21 shared between the above described components 14, 16 to 20. In this instance, the channel controller 10 is implemented by a program routine executed by the central processing unit 20, and a list of key assignment is formed in the random access memory 19.

The electronic keyboard musical instrument further comprises a sound system 22 connected to the tone generating unit 11, and the left speaker and the right speaker are incorporated in the sound system 22 together with a suitable amplifier for producing the stereophonic sounds.

While a player is performing a tune on the keyboard 13 and the pedals 15, the key sensor 14 produces the key-on signal KON and the key-off signal KOFF for the depressed/released keys 13*a*/13*b*. The central processing unit 20 periodically checks data input port assigned to the key sensor 14, the pedal sensor 16 and the manipulating panels 17 to see whether or not the player changes the status of any key 13*a*/13*b*, the status of the damper pedal 15 and the status of the switches. The player may select a timbre and an effect before the performance, and the central processing unit 20 produces music data codes representative of the timbre and the effect. These music data codes are stored in the suitable storage area.

When the player depresses and releases one of the black/white keys 13*a*/13*b* under the depression of the damper pedal 15, the central processing unit 20 determines a key-on status and a key-code assigned to the depressed/released key, a key touch and a key-off status. The central processing unit 20 further determines the pitch of stereophonic sound to be produced and an envelope value representative of a gradient of the decay.

The central processing unit 20 stores the pieces of music data in the list of key assignment in relation to the channel number. FIG. 4 illustrates the pieces of music data stored in the list of key assignment in the random access memory 19. The first row to the seventh row are respectively assigned to key status information, key codes, key touch information, kind of sound signal, coupling channel information, an envelop value and left/right speaker.

When a key 13*a*/13*b* is depressed, the key 13*a*/13*b* is in the key-on status, and the key-on status is represented by "1". On the other hand, when the player releases the depressed key 13*a*/13*b*, the released key 13*a*/13*b* enters into the key-off status represented by "0".

The black/white keys 13*a*/13*b* are sequentially numbered, and the key code represents the key number. For this reason, the key code identifies the depressed/released key 13*a*/13*b*, and, accordingly, specifies the pitch of the stereophonic sound to be produced.

The key touch represents the magnitude of the key-touch. When a sound generating channel is assigned to the fundamental sound signal, the kind of sound signal is represented by "1". On the other hand, the channel is assigned to the resonant sound signal, the kind of sound signal is represented by "0".

The coupling status represents whether or not the sound generating channel is coupled to another sound generating channel. If a sound generating channel and another sound generating channel are assigned to the fundamental sound signal for the left channel and the corresponding fundamental sound signal for the right channel, these sound generating channels are coupled to each other by using the same number. The sound generating channel for the fundamental sound signal and the sound generating channel for the corresponding resonant sound signal are also coupled by using the same number.

The envelop value represents the sound level of the stereophonic sound to be produced, and is rewritten by the central processing unit 20 at time intervals much shorter than time period occupied by the envelop. Even though the coupling status code associates a sound generating channel for the left speaker with another sound generating channel for the right speaker, the envelop value are not always equal between the sound generating channels, and, for this reason, the envelop value is given to each of the sound generating channels.

The seventh row represents the destination of the sound signal. If a sound generating channel propagates a fundamental/resonant sound signal to the left speaker, the destination is represented by "L". On the other hand, if the sound generating channel propagates the fundamental/resonant sound signal to the right speaker, the destination is represented by "R".

Investigating the list of key assignment, the sound generating channels "1", "2", "3" and "63" are coupled by using the coupling status code "1", and are assigned to the fundamental/resonant sound signals for a stereophonic sound. The sound generating channels "1" and "63" are assigned to the fundamental sound signal for the left speaker and the fundamental sound signal for the right speaker, respectively, and the sound generating channel "2" and "3" are assigned to the resonant sound signal for the right speaker and the resonant sound signal for the left speaker, respectively.

Figure 5:
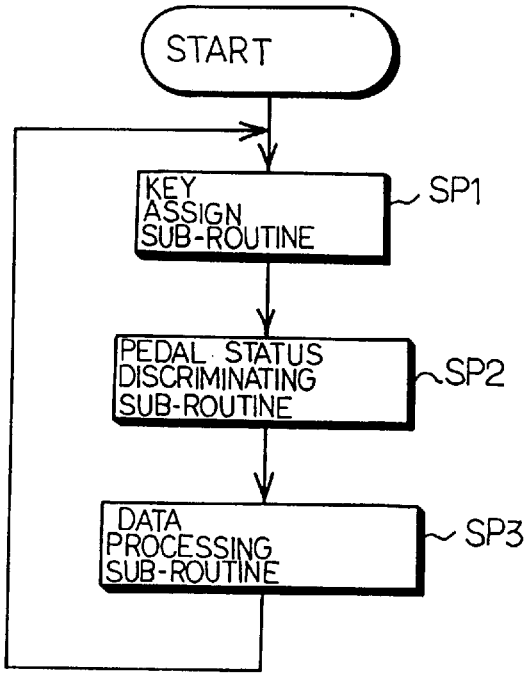
FIG. 5 is a flow chart showing a main program executed by a central processing unit of the electronic keyboard musical instrument.

The electronic keyboard musical instrument behaves as follows. FIG. 5 illustrates a main-routine program executed by the central processing unit 20. The main-routine program starts at the power-on. The central processing unit 20 checks the data input port to see whether or not a player changes the key status of any one of the black/white keys 13*a*/13*b*. If the central processing unit finds a change of the key status, the central processing unit 20 enters into a key assign sub-routine program SP1 so as to assign a set of sound generating channels to the black/white key 13*a*/13*b* as will be described in detail hereinlater.

On the other hand, if all the black and white keys 13*a*/13*b* do not change the key status or the key assign sub-routine program is completed, the central processing unit 20 proceeds to a pedal status discriminating sub-routine program SP2. The central processing unit 20 checks the data input port to see whether or not the player changes status of the damper pedal 15. The pedal status discriminating sub-routine SP2 is executed when the player changes the pedal status, i.e., from the released status to the depressed status or vice versa. The pedal status is memorized in a pedal status flag PD. Pedal-on status is represented by "1", and pedal-off status is represented by "0". The pedal status discriminating sub-routine program will be also described in detail hereinlater.

Subsequently, the central processing unit 20 enters into another data processing sub-routine program SP3, and carries out a data processing in response to the manipulation on the panel 17, by way of example. Upon completion of step SP3, the central processing unit 20 returns to step SPA, and reiterates the loop consisting of steps SP1 to SP3 until a power-off.

Figure 6:
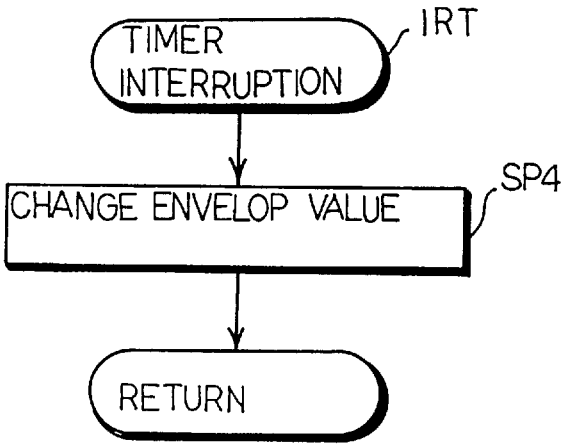
FIG. 6 is a flow chart showing a timer interrupt sub-routine program executed by the central processing unit.

While the central processing unit 20 is repeating the main-routine program, a timer interruption IRT periodically takes place at intervals as shown in FIG. 6, and the time intervals are much shorter than time period occupied by an envelop of the fundamental/resonant sound signal. When the timer interruption takes place, the central processing unit interrupts the main-routine program to change the envelop value in the list of key assignment as by step SP4 as will be described in detail hereinbelow. In step SP4, the central processing unit 20 firstly reads out the current envelop values of the fundamental/resonant sound signals from the envelop generator 11*d* of the tone generating unit 11, and changes the previous envelop values in the sixth row of the list to the current envelop values. If the envelop value of one of the fundamental/resonant sound signals is zero, the central processing unit 20 acknowledges that the sound generation through the sound generating channel is completed, and cancels the key code in the second row for releasing the sound generating channel from the key assignment. Thus, the key codes in the second row are indicative of the channel status, i.e., whether or not the sound generating channels have been assigned to any key 13*a*/13*b*.

Figure 7:
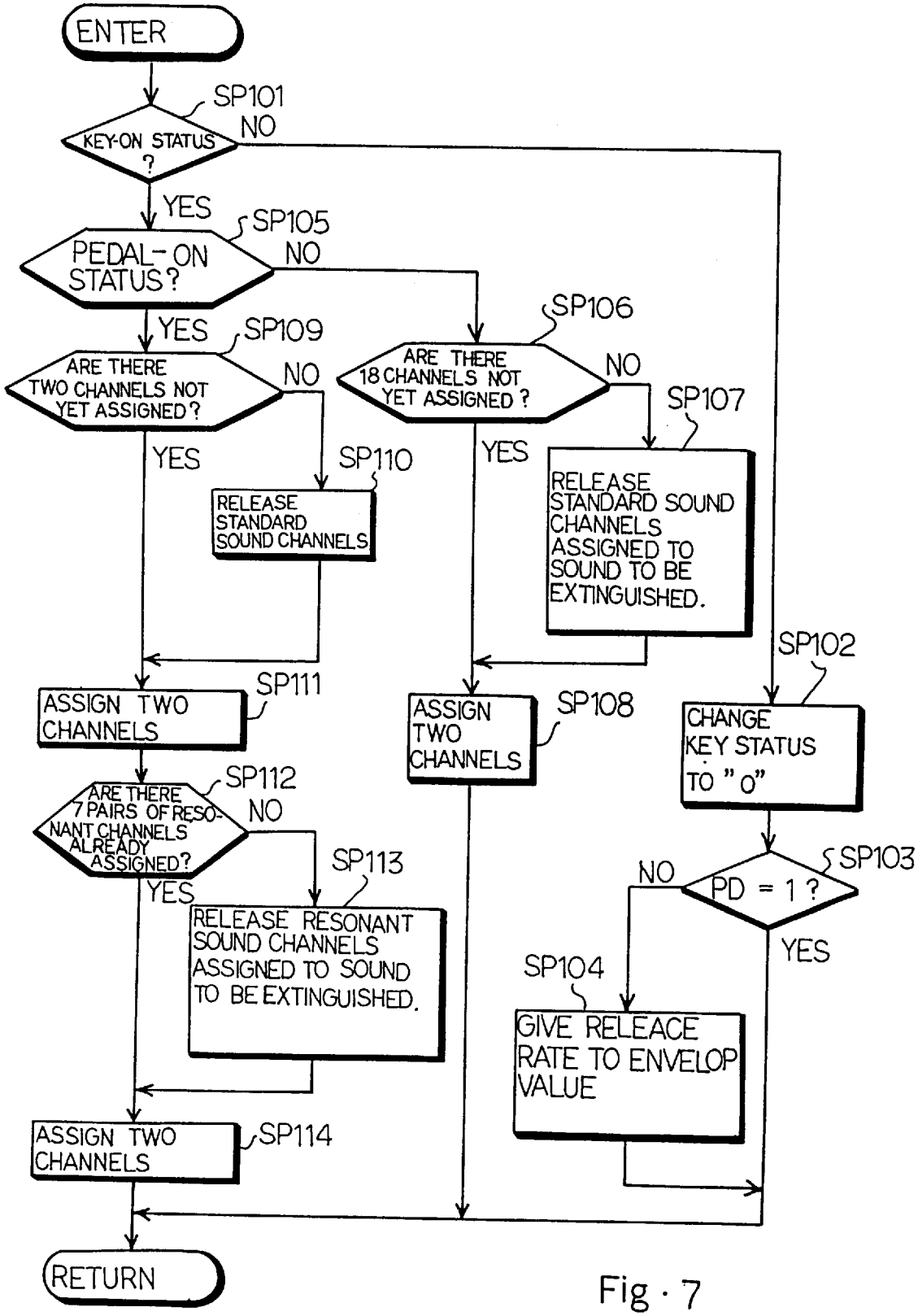
FIG. 7 is a flow chart showing a key assign sub-routine program executed by the central processing unit.
Figure 8:
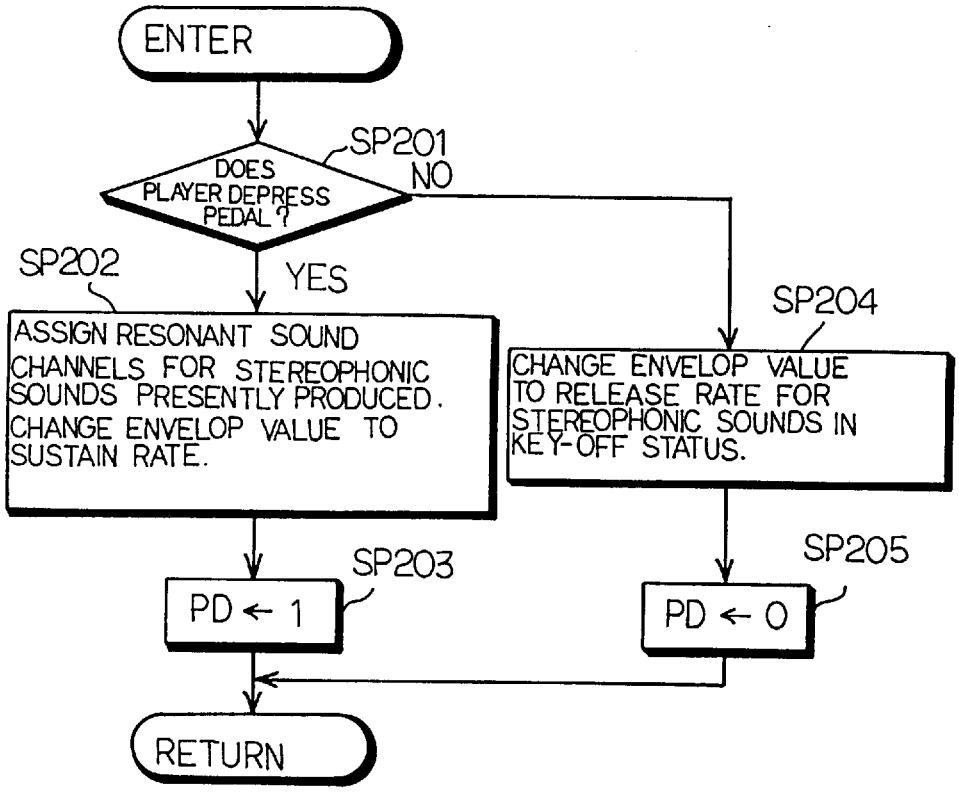
FIG. 8 is a flow chart showing a pedal status discriminating sub-routine program executed by the central processing unit.

Subsequently, the key assign sub-routine SP1 and the pedal status discriminating sub-routine SP2 are detailed with reference to FIGS. 7 and 8. FIG. 7 illustrates the key assign sub-routine program SP1, and FIG. 8 illustrates the pedal-status discriminating sub-routine program SP2.

When the key status of a black/white key 13*a*/13*b* is changed from the key-off status to the key-on status or vice versa, the central processing unit 20 enters into the key assign sub-routine program SP1, and checks the black/white key 13*a*/13*b* to see whether the black/white key 13*a*/13*b* enters into the key-on status or the key-off status as by step SP101.

If the black/white key 13*a*/13*b* is in the key-off status, the answer at step SP101 is given negative, and the central processing unit 20 proceeds to step SP102. In step SP102, the central processing unit 20 searches the second row for the key code of the black/white key 13*a*/13*b*, and identifies the sound generating channel assigned to the black/white key 13*a*/13*b*. Then, the central processing unit changes the key status to "0" representative of the key-off status.

Subsequently, the central processing unit 20 checks the pedal flag status PD to see whether or not the damper pedal 15 is in the pedal-on status or not as by step SP103. If the damper pedal 15 is in the pedal-off status, the answer at step SP103 is given negative, and the central processing unit 20 gives a release rate to the envelop value as by step SP104. Then, the envelop generator 11*d* rapidly decays the envelop of the fundamental sound signals for the black/white key 13*a*/13*b* et the given release rate. The central processing unit 20 returns to the main-routine program.

On the other hand, if the black/white key 13*a*/13*b* has been changed to the key-on status, the answer at step SP101 is given affirmative, and the central processing unit 20 checks the pedal status flag PD to see whether the damper pedal 15 is in the pedal-on status or not as by step SP105.

If the player does not depresses the damper pedal 15, the answer at step SP105 is given negative, and the central processing unit 20 proceeds to step SP106 so as to determine the lumber of sound generating channels not yet assigned. Namely, the central processing unit 20 checks the list of key assignment to see whether the sound generating channels not yet assigned are equal to or greater than eighteen or not as by step SP106. As described hereinbefore, any key code is not written into the second row for the sound generating channel not yet assigned. For this reason, the central processing unit 20 counts the sound generating channels without a key code.

If the sound generating channels not yet assigned are less than eighteen, the central processing unit 20 determines a stereophonic sound or sounds to be extinguished, and cancels the key code from the second row of the list of key assignment for the sound generating channels to be released as by step SP107. The tone generating unit 11 rapidly decays the envelope or envelops for the stereophonic sound or sounds, and the stereophonic sound or sounds are extinguished.

The stereophonic sound to be extinguished has the minimum loudness. If the stereophonic sound contains both of standard sound component and resonant sound components, four sound generating channels are released. On the other hand, the stereophonic sound only has the standard sound component, two sound generating channels are released. The stereophonic sound to be extinguished has the minimum envelop value for the sound generating channel, and the sound generating channel with the minimum envelop value and the sound generating channel coupled thereto are released from the key assignment. Otherwise, the central processing unit may average the envelope values of the sound generating channels for each stereophonic sound to determine the stereophonic sound to be extinguished.

When the central processing unit completes the job at step SP107 or the answer at step SP106 is given affirmative, two sound generating channels are assigned to the black/white key 13*a*/13*b* as by step SP108, and the central processing unit 20 writes "1" representative of the key-on status and the key code of the black/white key 13*a*/13*b* into the lift of key assignment for the selected sound generating channels. These pieces of music data are transferred to the tone generating unit 11, and the tone generating unit 11 produces a pair of fundamental sound signals for the left speaker and the right speaker. The central processing unit 20 returns to the main-routine program after step SP108. Thus, the central processing unit 20 assigns a pair of sound generating channels for the black/white key 13*a*/13*b* under the pedal-off status, and at least sixteen sound generating channels remain open after step SP18.

If the player has depressed the damper pedal 15, the answer at step SP105 is given affirmative, and the central processing unit checks the list of key assignment to see whether the sound generating channels not yet assigned are equal to or greater than two as by step SP109. When the sound generating channel available for the black/white key 13*a*/13*b* is less than two, the answer at step SP109 is given negative, and the central processing unit 20 releases a pair of standard sound channels as similar to step 107. As a result, the sound generating channels not yet assigned are increased to two or more.

When the job at step SP10 is completed or if the answer at step SP109 is given affirmative, the central processing unit 20 assigns a pair of sound generating channels to fundamental sound signals for the black/white key 13*a*/13*b* as by step SP111. The job at step SP111 is similar to the job at step SP108.

Subsequently, the central processing unit 20 checks the list of key assignment to see whether or not the seven pairs of resonant sound channels have been already assigned to other black/white keys 13*a*/13*b* as by step SP112. If more than seven pairs of sound generating channels have been assigned to other black/white keys 13*a*/13*b*, the answer at step SP1 12 is given negative, and the central processing unit 20 proceeds to step SP113. In step 113, the central processing unit 20 looks for a pair of resonant sound channels to be released, and instructs the tore generating unit 11 to release the pair of resonant sound channels. The pair of resonant sound channels to be released is assigned to the resonant sound components with the minimum loudness. One of the resonant sound channels may be assigned to the resonant sound components with the minimum loudness, or the pair of resonant sound signals may have the minimum loudness.

When the release is completed, or if the answer at step SP112 is given affirmative, the central processing unit 20 assigns a pair of sound generating channels to the resonant sound signals for the black/white key 13*a*/13*b* as by step SP114, and, thereafter, returns to the main-routine program.

When the central processing unit 20 enters into the pedal status discriminating sub-routine program SP2, the central processing unit 20 firstly checks the data input port to see whether or not the player depresses the damper pedal 15 as by step SP201. As described hereinbefore, the piece of dummy stroke data DMY is supplied to the multiplier 11*b*, and is changed between "1" and "0" depending upon the pedal status.

If the damper pedal 15 is depressed by the player, the answer at step SP201 is given affirmative, and the central processing unit 20 proceeds to step SP202. In step SP202, the central processing unit 20 assigns the resonant sound channels to the resonant sound signals for the stereophonic sounds presently produced, and the envelop values are changed to certain rate representing the sustain for the resonant sound signals and the fundamental sound signals for the black/white keys 13*a*/13*b* already entered into the key-off status. As a result, the resonant sound components are mixed with the standard sound component of each stereophonic sound. The sound level of the resonant sound component is different between the key-on status and the key-off status. When the central processing unit 20 assigns the resonant sound channels, the key status is checked, and the central processing unit 20 gives a the resonant sound components for the black/white key 13*a*/13*b* in the key-on status a sound level higher than that of the resonant sound components for the black/white key 13*a*/13*b* in the key-off status.

If the stereophonic sounds presently produced are more than eight, i.e., eight fundamental sound signals for the left speaker and eight fundamental sound signals for the right speaker, the central processing unit 20 selects loudest eight stereophonic sounds, and assigns the resonant sound signals for these sixteen stereophonic sounds.

Description is supplemented for the black/white keys 13*a*/13*b* already entered into the key-off state. In an acoustic piano, a player depresses a black/white key from the rest position to the end position, and the hammer escapes from the key action mechanism on the way from the rest position to the end position. The hammer strikes a set of strings, and the strings vibrate for producing an acoustic sound. While a player maintains the black/white key in the key-on status, the damper is spaced from the strings, and the strings continuously vibrate. When the player releases the depressed black/white key, the black/white key enters into the key-off status, and the damper is brought into contact with the vibrating strings. For this reason, the vibrations are rapidly decayed. However, the strings continue to vibrate for short time. The black/white key 13*a*/13*b* already entered into the key-off status is corresponding to the black/white key vibrating under the contact with the damper. When the central processing unit 20 changes the envelop value to the sustain rate, the stereophonic sound is prolonged as if the damper is spaced from the vibrating strings again, and is gently decayed thereafter.

Thereafter, the central processing unit 20 changes a pedal status flag PD to "1" representative of the pedal-on status as by step SP203, and returns to the main-routine program.

On the other hand, if the answer at step SP201 is given negative, the player has released the damper pedal 15 after the execution of the previous pedal status discriminating subroutine, and the central processing unit 20 changes the envelop values of the fundamental/resonant sound signals for the black/white keys 13*a*/13*b* in the key-off status to respective release rates as by step SP204. Then, the envelope generator 11*d* rapidly decays the envelopes of the fundamental/resonant sound signals, and, accordingly, the stereophonic sounds are extinguished.

Subsequently, the central processing unit 20 changes the pedal status flag to value "0" representative of the pedal-off status as by step SP205, and returns to the main-routine program.

The resonant sound components are added to the standard sound components when the damper pedal 15 is depressed in the presence the standard sound components or when a black/white key 13*a*/13*b* is depressed under the depression of the damper pedal 15. For this reason, the sound generating channels are assigned to the resonant sound signals for a depressed black/white key 13*a*/13*b* in both of the key assign sub-routine program SP1 and the pedal status discriminating sub-routine program SP2. For this reason, the resonant sound components are added to the stereophonic sound or sounds at the suitable timing.

As will be understood from the foregoing description, only sixteen sound generating channels are assignable to the eight pairs of resonant sound signals concurrently produced, and the remaining sound channels, i.e., forty-eight sound generating channels are available for twenty-four pairs of standard sound signals. Thus, the electronic keyboard musical instrument according to the present invention can concurrently produce more than a quarter of the total sound generating channels.

Moreover, the electronic keyboard musical instrument according to the present invention forcibly extinguishes the standard sound component or the resonant sound components with the minimum loudness, and the player and the listener hardly notice the extinguished sound.

Even though the sound generating channels assignable to the fundamental sound signals are greater than the sound generating channels assignable to the resonant sound signals, at least sixteen sound generating channels remain open for the resonant sound signals (see steps SP106 and SP112). For this reason, when the player depresses the damper pedal 15, the resonant sound signals are immediately produced for the stereophonic sounds currently produced. Moreover, the standard sound channels are cancelled before the cancellation of the resonant sound channels (see steps SP110 and SP113), and there is no possibility to produce resonant sound components without the standard sound component.

In this instance, the black and white keys 13*a*/13*b* serve as a plurality of tone specifying means, and a musical effect applying means is implemented by the damper pedal 15. The tone generator 11*a* with the envelop generator 11*d*, the central processing unit 20 and the timer interruption subroutine program and steps SP101 to SP104, SP202 and SP204 as a whole constitute a signal generating means. The central processing unit 20 and steps SP105 to SP114 as a whole constitute a channel controlling means. A first counting sub-means, a first comparing sub-means, a first releasing sub-means, a first assigning sub-means, a second counting sub-means, a second comparing sub-means, a second releasing sub-means and a second assigning sub-means are implemented by steps SP109, SP109, SP110, SP111, SP112, SP112, SP113 and SP114, respectively.

Second Embodiment

Figure 9:
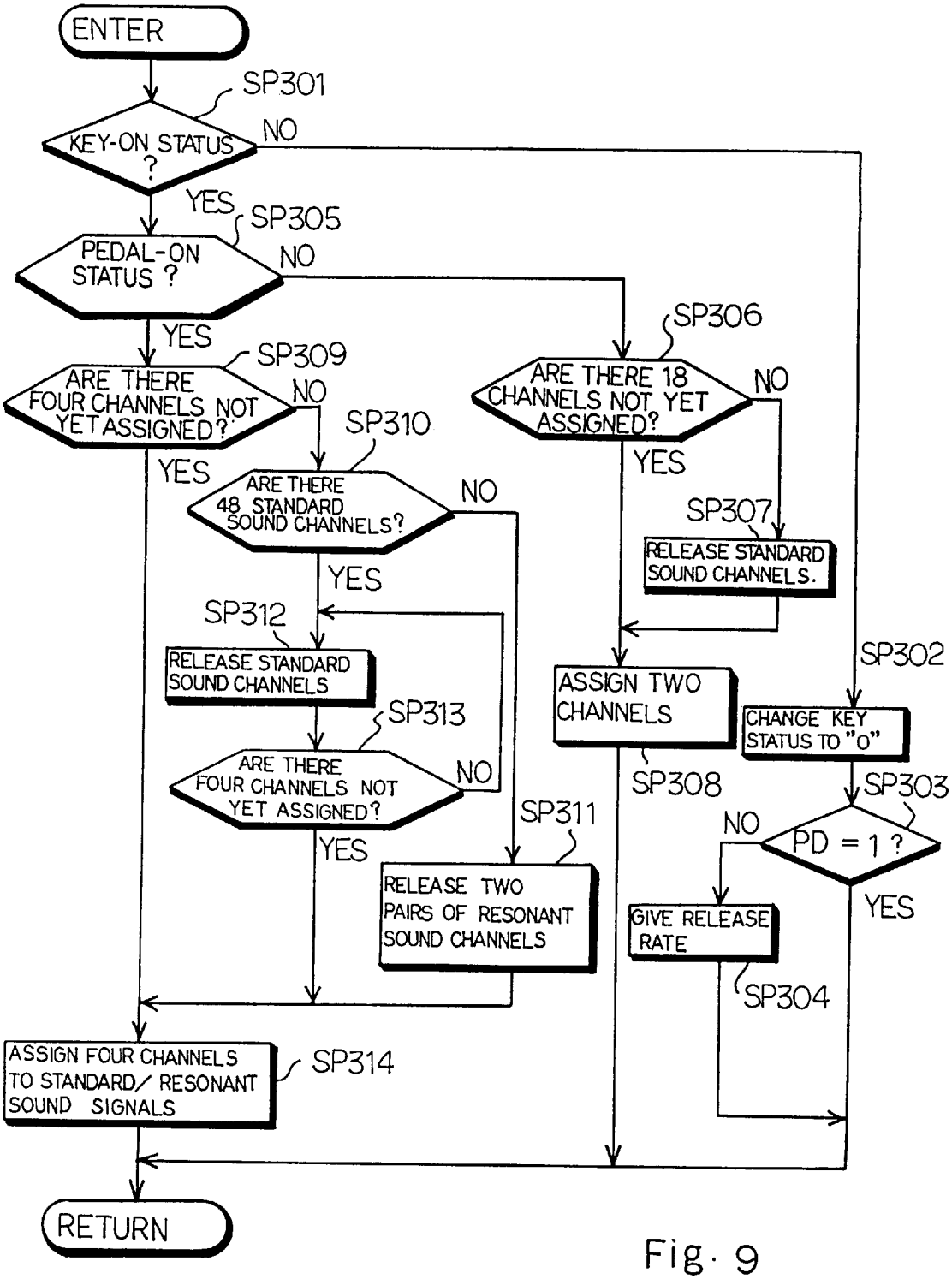
FIG. 9 is a flow chart showing a key assign sub-routine program executed by a central processing unit of another electronic keyboard musical instrument according to the present invention.

FIG. 9 illustrates a key assign sub-routine program executed by a central processing unit incorporated in another electronic keyboard musical instrument. The electronic keyboard musical instrument implementing the second embodiment is similar to the first embodiment except for a tone generating unit and the key assign sub-routine program. For this reason, description is focused on the tone generating unit and the key assign sub-routine program, and components of the electronic keyboard musical instrument are hereinbelow labeled with the references designating corresponding components of the first embodiment.

The tone generating unit 11 is of the multi-timber type, and varies the sound generating channels assignable to the resonant sound signals depending upon the number of stereophonic sound presently produced. However, the minimum number of the sound generating channels assignable to the resonant sound signals is sixteen as similar to the first embodiment.

When a black/white key 13*a*/13*b* changes the key status, the main-routine program is branched to the key assign sub-routine program shown in FIG. 9. If the black/white key

13*a*/13*b* is changed from the key-on status to the key-off status, the central processing unit sequentially executes the steps SP301 to SP304, and the jobs at steps SP301 to SP304 are similar to those at step SP101 to SP104. On the other hand, if the black/white key 13*a*/13*b* is changed from the key-off status to the key-on status without depression of the damper pedal 15, the central processing unit 20 sequentially executes steps SP301, SP305 to SP308, and the jobs at these steps are also similar to those at steps 101, SP105 to SP108. For this reason, description on steps SP301 to SP308 is omitted for the sake of simplicity.

If the black/white key 13*a*/13*b* is changed from the key-off status to the key-on status under the depression of the damper pedal 15, the central processing unit 20 checks the list of key assignment to see whether or not there are at least four sound generating channels not yet assigned as by step SP309. If the sound generating channels not yet assigned are less than four, the answer at step SP309 is given negative, and the central processing unit 20 proceeds to step SP310.

At step SP310, the central processing unit 20 checks the list of key assignment to see whether or not the standard sound channels are equal to forty-eight. The inquiry at step SP310 is equivalent to the inquiry whether or not there are sixteen resonant sound channels already assigned and not yet assigned to the resonant sound signals. If the answer at step SP310 is given negative, at least eighteen sound generating channels have been already assigned to the resonant sound signals, and the central processing unit 20 releases two pairs of resonant sound channels from the key assignment as by step SP311. One of the two pairs of resonant sound channels is occupied by a pair of resonant sound signals with the minimum loudness, and the other pair of resonant sound channels is used by a pair of resonant sound signals with the loudness next to the minimium loudness. The tone generating unit 11 rapidly decays the envelopes of the two pairs of resonant sound signals, and extinguishes the resonant sound components. As a result, the sound generating channels not yet assigned are increased to four or more than four.

On the other hand, if the answer at step SP310 is given affirmative, sixteen sound generating channels have been already assigned to the resonant sound signals, and the central processing unit 20 proceeds to step SP312. At step SP312, the central processing unit 20 releases the standard sound channels from the key assignment as similar to step SP107, and the tone generating unit 11 rapidly decays the standard sound components. A pair of standard sound signals is not always accompanied with a pair of resonant sound signals. For this reason, the central processing unit 20 checks the list of key assignment to see whether or not there remains four sound generating channels not yet assigned as by step SP313. The central processing unit 20 repeats the loop consisting of steps SP312 and ST313 until the answer at step 313 is changed to "yes".

When the job at step SP311 or SP313 is completed, or if the answer at step SP309 is given affirmative, the central processing unit 20 assigns the four sound generating channels to a pair of standard sound signals and a pair of resonant sound signals for producing the stereophonic sound corresponding to the black/white key 13*a*/13*b* as by step SP314. Thereafter, the central processing unit 20 returns to the main-routine program.

Thus, the key assign sub-routine program shown in FIG. 9 allows the central processing unit 20 to change the number of resonant sound channels depending upon the number of stereophonic sounds presently produced. When the stereophonic sounds presently produced range from one to sixteen, the central processing unit 20 assigns the sound generating channels to the resonant sound signals for all the depressed keys 13*a*/13*b*. When the stereophonic sounds are increased to seventeen to twenty-three, the central processing unit 20 selectively assigns the sound generating channels to more than eighteen resonant sound signals for the stereophonic sounds with large loudness. When the stereophonic sounds are increased to twenty-four or more, the central processing unit 20 assigns the sound generating channels to the sixteen resonant sound signals for the stereophonic sounds with large loudness.

Third Embodiment

In the first and second embodiments, the assignment of sound generating channels are linked with the lone generation, and the assignment of sound generating channels is carried out both of the key assign sub-routine program and the pedal status discriminating sub-routine program. However, the assignment of sound generating channels is separated from the tone generation in the third embodiment.

Figure 10:
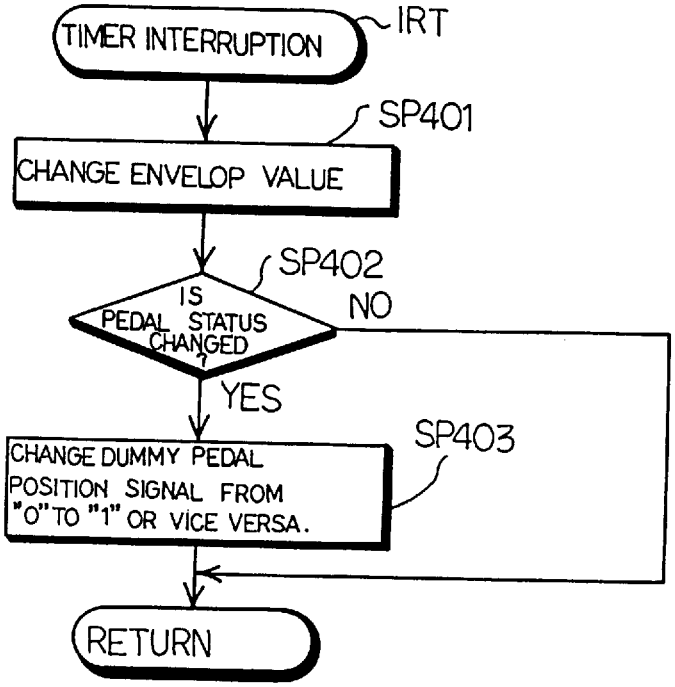
FIG. 10 is a flow chart showing a timer interruption sub-routine program executed by a central processing unit of yet another electronic keyboard musical instrument.

FIG. 10 illustrates a timer interruption sub-routine program executed by a central processing unit of yet another electronic keyboard musical instrument. The electronic keyboard musical instrument implementing the third embodiment is similar in arrangement to the first embodiment except for sub-routine programs described hereinbelow. For this reason, description is focused on a timer interruption sub-routine program, a pedal status discriminating sub-routine program and a key assign sub-routine program, and components of the electronic keyboard musical instrument are hereinbelow labeled with the references designating corresponding components of the first embodiment.

The timer interruption IRT periodically takes place at intervals much shorter than the time period occupied by an envelop, and the central processing unit 20 enters into the timer interruption sub-routine program shown in FIG. 10. The central processing unit 20 firstly changes the envelop value or values as by step SP401, and checks the pedal status flag PD to see whether or not a player changes the pedal status as by step SP402. If the player has not changed the pedal status after the previous timer interruption, the answer at step SP402 is given negative, and the central processing unit 20 returns to the main-routine program.

On the other hand, if the player has changed the pedal status, the answer at step SP402 is given affirmative, and the central processing unit 20 changes the piece of dummy pedal stroke data DMY from "1" to "0" or vice versa as by step SP403. As described in conjunction with the tone generating unit 11 shown in FIG. 2, the piece of dummy stroke data DMY is supplied to the multiplier 11*b*, and the pieces of resonant sound data represented by the resonant sound signal PS10 are multiplied by piece of dummy stroke data DMY. If the piece of dummy stroke data DMY is "0", the multiplication results in "0", and the resonant sound components are removed from the stereophonic sound. In other words, the multiplier 11*b* serves as a switching element for the resonant sound signals, and the dummy stroke data DMY behaves as a switching control signal. In this instance, the generation of the resonant sound components is controlled by the dummy stroke data DMY, and is separated from the assignment of sound generating channels. If the piece of dummy stroke data is simply changed between "1" to "0", the rapid change is causative of undesirable noise. For this reason, the piece of dummy stroke data DMY is interpolated, and is changed in such a manner as to be "1", "0.9", "0.8", "0.1", "0". A series of dummy stroke data may be stored in a suitable memory, or is successively calculated by the central processing unit 20.

The separation between the assignment of sound generating channel and the generation of resonant sound components simplifies a pedal status discriminating sub-routine program and a key assign sub-routine program.

Figure 11:
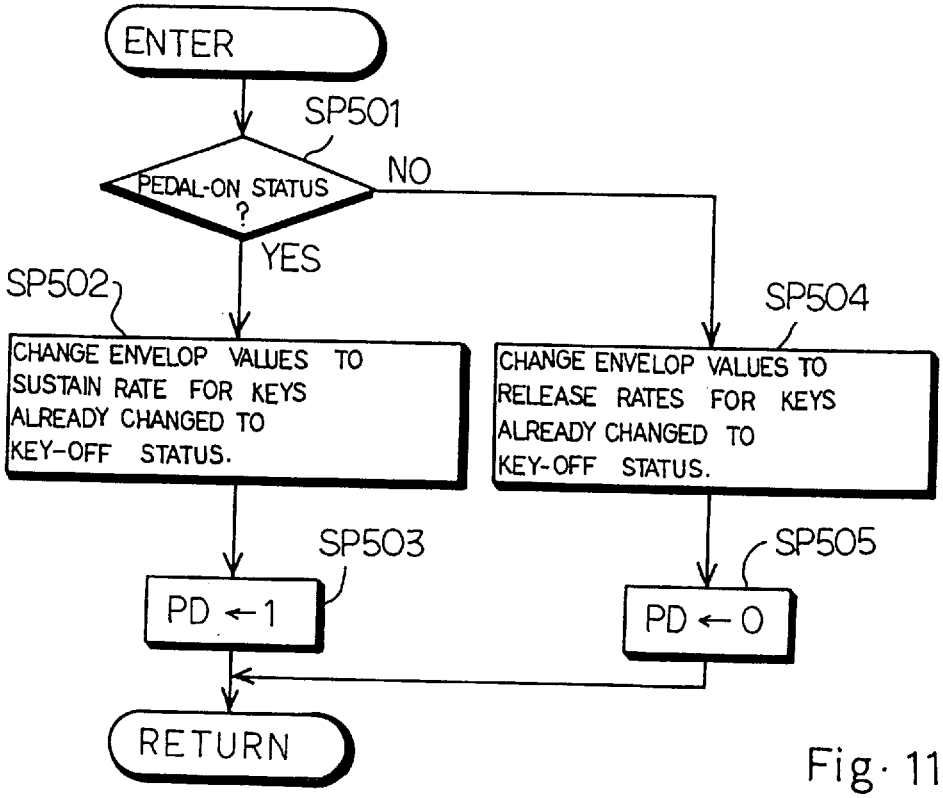
FIG. 11 is a flow chart showing a pedal status discriminating sub-routine program executed by the central processing unit.

FIG. 11 illustrates the pedal status discriminating sub-routine program. When the main-routine program is branched to the pedal status discriminating sub-routine program, the central processing unit 20 checks the pedal status flag PD to see whether or not the damper pedal 15 is in the pedal-on status as by step SP501.

When the damper pedal 15 is in the pedal-on status, the answer at step SP501 is given affirmative, and the central processing unit 20 changes the envelop value or values in the list of key assignment to sustain rates for the black/white keys 13*a*/13*b* already changed to the key-off status as by step SP502. The central processing unit 20 changes both of the envelope values of the resonant sound signals and the envelop values of the standard sound signals. As a result, the player prolongs the stereophonic sounds. Thereafter, the central processing unit 20 changes the pedal status flag PD to "1" as by step SP503, and returns to the main-routine program.

On the other hand, if the damper pedal 15 is in the pedal-off status, the answer at step SP501 is given negative, and the central processing unit 20 changes the envelop value or values to release rates for the black/white keys 13*a*/13*b* already changed to the key-of status as by step SP504. As a result, the stereophonic sounds are decayed as usual. The central processing unit 20 changes the pedal status flag PD to "0" as by step SP505, and returns to the main-routine program.

Thus, an assignment of resonant sound channels is not carried out in the pedal status discriminating sub-routine program, and the pedal status discriminating sub-routine program is simpler than that of the first embodiment.

Figure 12:
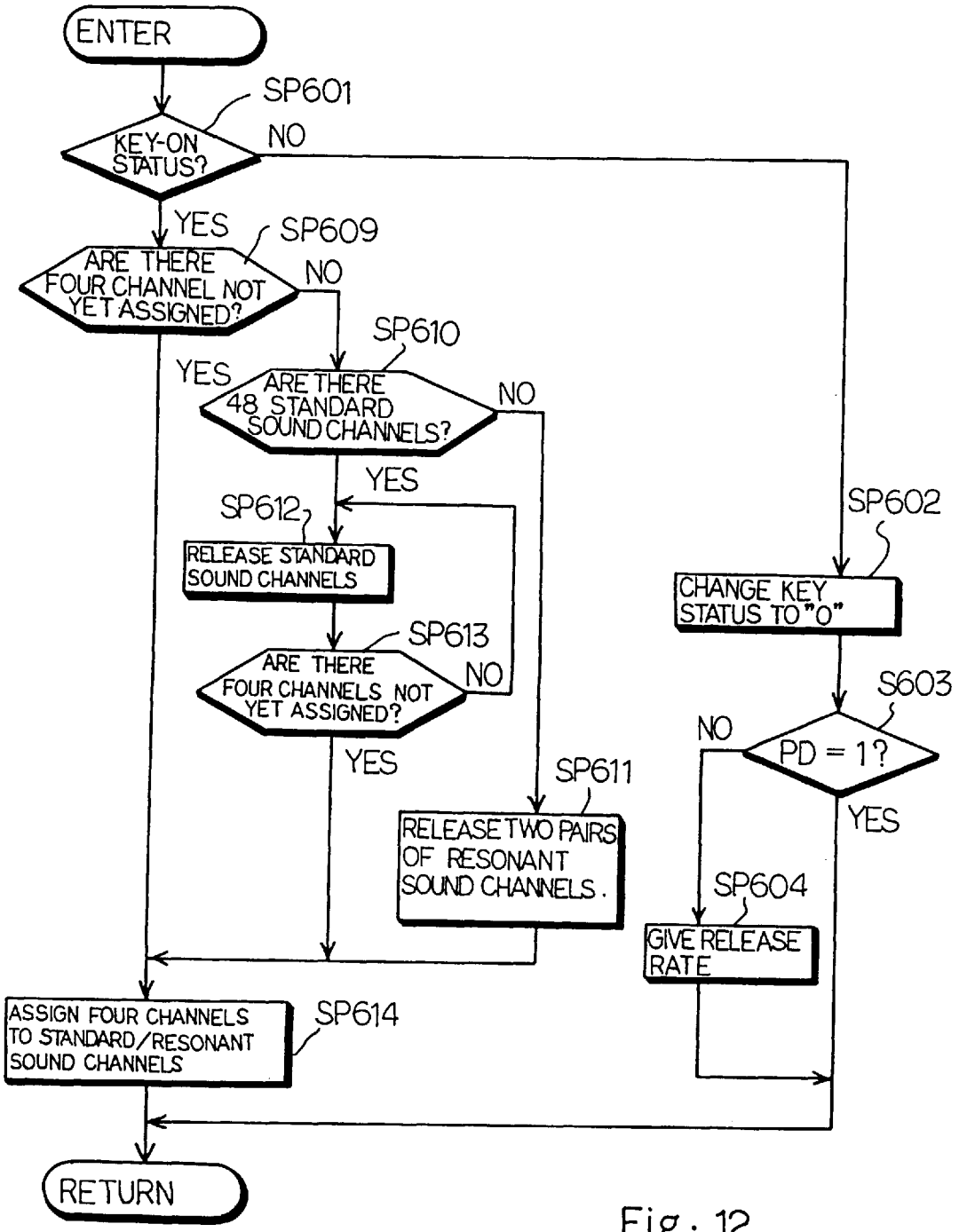
FIG. 12 is a flow chart showing a key assign sub-routine program executed by the central processing unit.

FIG. 12 illustrates the key assign sub-routine program executed by the central processing unit of the third embodiment. The jobs at steps SP601 to SP604 and SP609 to SP614 are similar to the jobs at step SP301 to SP304 and SP309 to SP314, and no further description is incorporated hereinbelow for avoiding repetition. As described hereinbefore, the generation of resonant sound components is carried out by changing the piece of dummy stroke data DMY to "1". For this reason, the central processing unit 20 does not check the pedal status flag PD before the assignment of sound generating channels at steps SP609 to SP614, and steps SP305 to 308 are not incorporated in the key assign sub-routine program for the third embodiment.

The central processing unit 20 assigns the sound generating channels to the fundamental sound signals and the resonant sound signals regardless of the pedal status, and the multiplier 11*b* serves as a switching element in response to the piece of dummy stroke data DMY. Thus, the key assign subroutine program for the third embodiment is simpler than that of the second embodiment. Moreover, it is easy to give different envelop rates to the resonant sound signals depending upon the selected timbre and the key touch, and the assignment of sound generating channels is not concentrated at the depression of the damper pedal 15. Finally, if the player depresses the damper pedal 15 after generation of a stereophonic sound, the tone generating unit 11 has changed the envelop values of the pair of resonant sound signals together with the envelop values of the pair of the standard sound signals, and suitable resonant sound components are immediately added to the standard sound components upon the depression of the damper pedal 15.

Although particular embodiments of the present invention have been shown and described, it will be obvious to those skilled in the art that various changes and modifications may be made without departing from the spirit and scope of the present invention.

For example, the channel controller according to the present invention is applicable to any kind of electronic musical instrument concurrently producing more than one sound and selectively imparting a certain effect to the sounds.

In the above described embodiments, the resonant sound components are mixed into the stereophonic sounds produced at the depression of the damper pedal 15. However, the resonant sound signal may be produced for a standard sound signal for a selected sound.

An electronic musical instrument according to the present invention may produce monophonic sounds. In this instance, the monophonic sound is produced from a single fundamental sound signal without a depression of a damper pedal and the monophonic sound from the combination of the fundamental sound signal and a resonant sound signal under the depression of the damper pedal. For this reason, each value in the flow charts is decreased to a half.

In the first and second embodiments, the sound generating channels not yet assigned may be two (see steps SP106 and SP306) so as to assign the sound generating channels to 32 pairs of standard sound signals at the maximum. In this instance, the central processing unit 20 restricts the standard sound components presently produced to twenty-four or less at step SP202.

What is claimed is:

1. An electronic musical instrument capable of concurrently producing more than one electronic sound, comprising:

a plurality of tone specifying means manipulated by a player for specifying a note of a fundamental sound to be produced, said player being able to manipulate more than one tone specifying means so as to specify more than one fundamental sound to be concurrently produced;

at least one musical effect applying means manipulated by said player for imparting a music effect to said fundamental sound or said more than one fundamental sound; and a tone generating means for producing said fundamental sound or said more than one fundamental sound without a manipulation of said at least one musical effect applying means, and imparting said music effect to said fundamental sound or said more than one fundamental sound under the manipulation of said at least one music effect modifying means, said tone generating means including a plurality of sound generating channels selectively assigned to a fundamental sound signal representative of said fundamental sound or fundamental sound signals representative of said more than one fundamental sound, said plurality of sound generating channels being further assigned to a sound modifying signal associated with said fundamental sound signal for imparting said musical effect to said fundamental sound or sound modifying signals respectively associated with said more than one fundamental sound signal for imparting said music effect to said more than one fundamental sound;

a signal generating means responsive to said plurality of tone specifying means and said at least one musical effect applying means for producing said fundamental sound signal, said fundamental sound signals, the combination of said fundamental sound signal and said sound modifying signal or the combination of said fundamental sound signals and said sound modifying signals, and a channel controlling means checking said sound generating channels to see whether or not the sound generating channels assigned to said sound modifying signals exceed a predetermined number equal to or less than the maximum number of sound generating channels assignable to said fundamental sound signals, said channel controlling means restricting the total number of sound generating channels assigned to said sound modifying signals equal to or less than said predetermined number.

2. The electronic musical instrument as set forth in claim 1, in which said channel controlling means releases at least one sound generating channel from the assignment to one of said sound modifying signals for an electronic sound with the minimum loudness when said sound generating channels assigned to said sound modifying signals exceed said predetermined number, and assigns said at least one sound generating channel to another of said sound modifying signals to be produced.

3. The electronic musical instrument as set forth in claim 2, in which said channel controlling means includes a first counting sub-means for counting sound generating channels not yet assigned, a first comparing sub-means comparing the number of said sound generating channels not yet assigned with a first certain value representative of a first minimum requirement to see whether or not one of said fundamental sound signals to be produced is assigned said sound generating channels not yet assigned, a first releasing sub-means releasing at least one sound generating channel already assigned to another of said fundamental sound signals from the assignment when said one of said fundamental sound signals can not be assigned said sound generating channels not yet assigned, a first assigning sub-means assigning said sound generating channels not yet assigned or the total of said sound generating channels not yet assigned and said at least one sound generating channel released by said first releasing sub-means to said one of said fundamental sound signals to be produced, a second counting sub-means counting sound generating channels already assigned to sound modifying signals presently produced, a second comparing sub-means comparing said sound generating channels already assigned to said sound modifying signals presently produced with said predetermined number to see whether or not there is said at least one sound generating channel to be assigned to said another of said sound modifying signals associated with said one of said fundamental sound signals to be produced, a second releasing sub-means releasing at least one of said sound generating channels already assigned to said one of said sound modifying signals from the assignment when said at least one sound generating channel is not found, and a second assigning sub-means assigning said at least one sound generating channel or said at least one of said sound generating channels released by said second releasing sub-means to said another of said sound modifying signals.

4. The electronic musical instrument as set forth in claim 1, in which said predetermined number is variable depending upon the number of electronic sounds presently produced.

5. The electronic musical instrument as set forth in claim 4, in which said channel controlling means further includes a volume controlling means connected to said plurality of sound generating channels assigned to said sound modifying signal or said sound modifying signals for changing a magnitude of said sound modifying signal or magnitudes of said sound modifying signals depending upon status of said at least one music effect applying means.

6. The electronic musical instrument as set forth in claim 1, in which a plurality of turnable keys of a keyboard and a pedal serve as said plurality of tone specifying means and said at least one music effect applying means, respectively.

7. The electronic musical instrument as set forth in claim 6, in which said music effect is a resonance produced by overtones.

* * * * *